US008262544B1

(12) United States Patent
Blackford

(10) Patent No.: US 8,262,544 B1
(45) Date of Patent: Sep. 11, 2012

(54) EXERCISE DEVICE

(76) Inventor: Richard Blackford, Venice, FL (US)

( * ) Notice: Subject to any disclaimer, the term of this patent is extended or adjusted under 35 U.S.C. 154(b) by 6 days.

(21) Appl. No.: 12/661,952

(22) Filed: Mar. 26, 2010

Related U.S. Application Data

(63) Continuation-in-part of application No. 12/151,212, filed on May 5, 2008, now Pat. No. 7,686,747, which is a continuation-in-part of application No. 11/478,867, filed on Jun. 30, 2006, now abandoned.

(51) Int. Cl.
*A63B 21/065* (2006.01)

(52) U.S. Cl. ..... 482/105

(58) Field of Classification Search ..... 482/82, 482/91–95, 97–98, 105, 109, 148; 600/29–30; 473/334–339; *A63B 21/065*
See application file for complete search history.

(56) References Cited

U.S. PATENT DOCUMENTS

| | | | | |
|---|---|---|---|---|
| 647,220 | A | 4/1900 | Courtney | |
| 3,116,926 | A | 1/1964 | Owen et al. | |
| 4,895,363 | A | 1/1990 | Plevnik et al. | |
| 5,213,557 | A | 5/1993 | Firth | |
| 5,554,092 | A | 9/1996 | Harpstead et al. | |
| 6,068,581 | A * | 5/2000 | Anderson | 482/93 |
| 6,406,407 | B1 * | 6/2002 | Wiedmann et al. | 482/82 |
| 7,686,747 | B1 * | 3/2010 | Blackford | 482/105 |
| 2004/0038783 | A1 * | 2/2004 | Hunter | 482/105 |

* cited by examiner

*Primary Examiner* — Oren Ginsberg

(57) ABSTRACT

A forward component has a frusto-conical forward section terminating in a recess and a cylindrical rearward section terminating with male screw threads. A rearward component has a cylindrical forward section terminating with female threads and a rearward section with a cylindrical recess. A support, removably positioned within the forward and rearward components, has a frusto-conical leading region, an intermediate region, and a cylindrical trailing region. A plurality of annular weights with cylindrical apertures are positioned on the trailing region of the support.

2 Claims, 2 Drawing Sheets

FIG 1
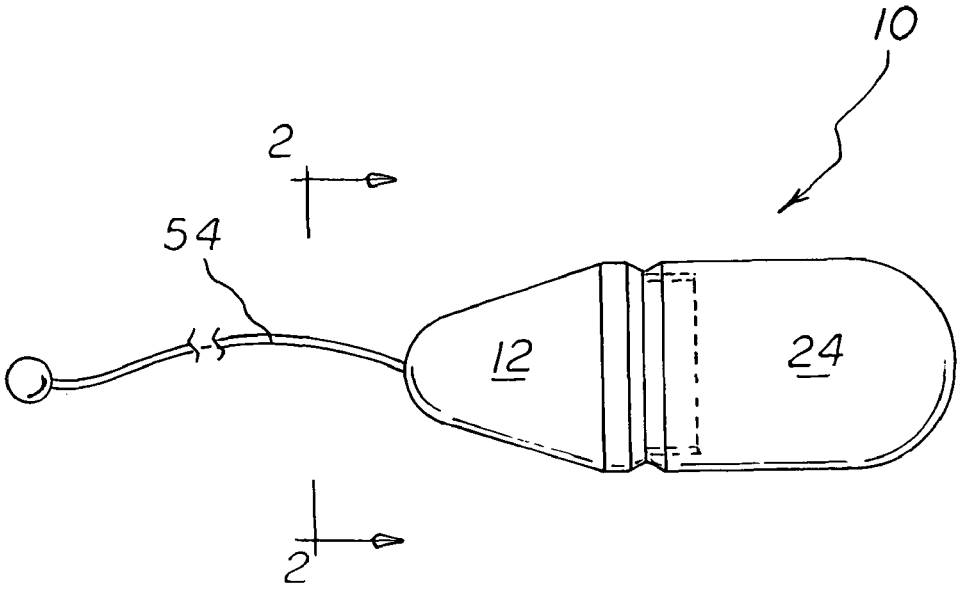
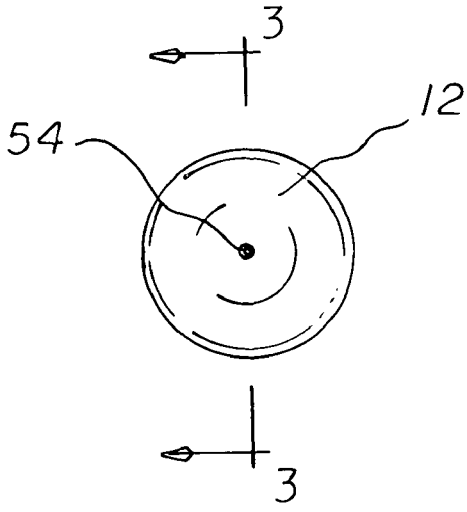
FIG 2

FIG 3
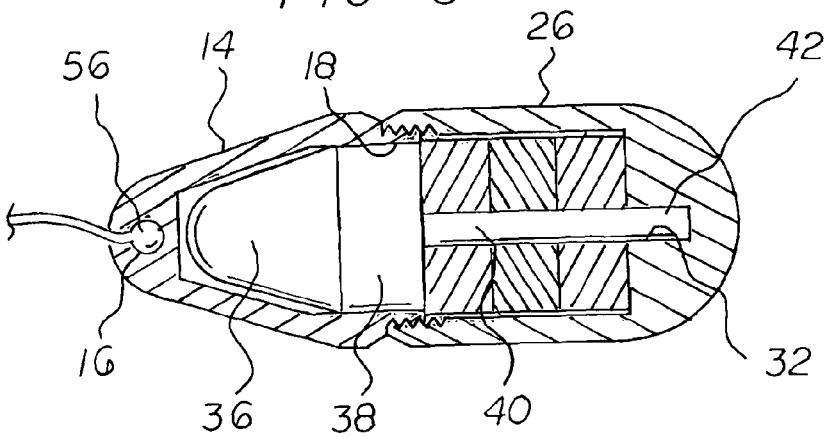
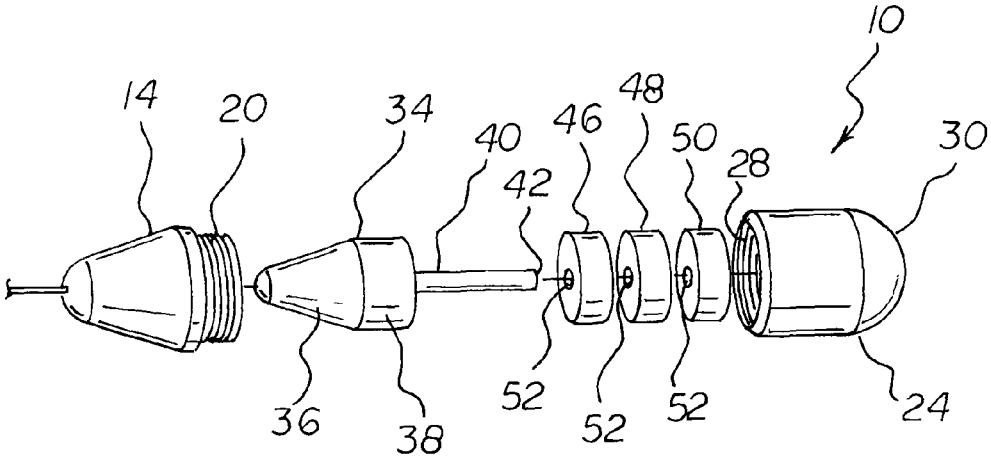
FIG 4

EXERCISE DEVICE

RELATED APPLICATION

The present application is a continuation-in-part of U.S. patent application Ser. No. 12/151,212 filed May 5, 2008 now U.S. Pat. No. 7,686,747 which is, in turn, a continuation-in-part of U.S. patent application Ser. No. 11/478,867 filed Jun. 30, 2006 now abandoned, the subject matter of which applications is incorporated herein by reference.

BACKGROUND OF THE INVENTION

Field of the Invention

The present invention relates to a pelvic muscle strengthening device and, more particularly, to such a device which includes a weight-adjusting means to permit the device to be adjusted to permit the use of the device with heavier weights as the pelvic muscles are strengthened through exercise with the device.

Strengthening the pelvic muscles through exercise is a common treatment for urinary incontinence in women. Various exercise devices have been provided in the past for this purpose. Such devices are intended to be inserted into the vagina of the patient. When the devices are inserted into the vagina, the pelvic muscles grip the device, thereby exercising the pelvic muscles. In this way, the repeated exercise over time strengthens the pelvic muscles, thereby reducing, and even eliminating, the problem of urinary incontinence.

As the pelvic muscle strengthens, devices of increased weight can be retained by the vagina. To obtain maximum benefit, it is desirable to provide an increasingly heavier device during the exercise program.

Also, of course, different women have a different starting point as to the weight of the device that can be retained in the vagina by exerting the pelvic muscles.

U.S. Pat. No. 4,895,363 discloses a set of devices of the same size and shape but of different weights. The proper device of the proper weight is selected for the patient, and, as the pelvic muscles of the patient strengthen, a heavier device is selected and used by the patient.

U.S. Pat. No. 5,213,557 discloses a device for exercising pelvic floor muscles. U.S. Pat. No. 5,554,092 discloses a set of devices of different sizes, each device capable of accommodating different weights. Also of interest are U.S. Pat. Nos. 647,220 to Courtney and 3,116,926 to Owen.

While the prior art devices recognize the need for a device of this type which is capable of providing exercise for patients with different pelvic muscle strength and for patients as their pelvic muscles strengthen, the solutions in the prior art have been unduly complicated and require a multitude of different devices.

In this respect, the exercise device according to the present invention substantially departs from the conventional concepts and designs of the prior art, and in doing so provides an apparatus primarily developed for the purpose of strengthening pelvic muscles.

Therefore, it can be appreciated that there exists a continuing need for a new and improved exercise device which can be used for strengthening pelvic muscles. In this regard, the present invention substantially fulfills this need.

SUMMARY OF THE INVENTION

In view of the foregoing disadvantages inherent in the known types of pelvic exercise devices now present in the prior art, the present invention provides an improved exercise device. As such, the general purpose of the present invention, which will be described subsequently in greater detail, is to provide a new and improved exercise device which has all the advantages of the prior art and none of the disadvantages.

The present invention is for insertion into the vagina of a patient for use in strengthening pelvic muscles. First provided is a forward component. The forward component has an inner surface, an outer surface, and a hollow interior. The forward component has a frusto-conical forward section terminating in a forward recess extending into the outer surface. The forward component has a cylindrical rearward section terminating rearwardly. Male screw threads are provided in the outer surface.

Next provided is a rearward component. The rearward component has an inner surface, an outer surface, and a hollow interior. The rearward component has a cylindrical forward section terminating forwardly. Female screw threads are provided in the inner surface. The rearward component has a hemispherical rearward section. A cylindrical recess is provided in the inner surface. The male screw threads of the forward component are adapted to releasably couple with the female screw threads of the rearward component for providing access to the hollow interiors of the forward and rearward components.

A support is next provided. The support is removably positioned within the hollow interiors of the forward and rearward components. The support has a frusto-conical leading region positioned in the forward section of the forward component. The support has a cylindrical intermediate region positioned in the rearward section of the forward component. The support has a cylindrical trailing region positioned in the forward section of the rearward component and terminating in a trailing end positioned within the cylindrical recess of the rearward component.

Next, a plurality of similarly configured annular weights with cylindrical apertures are provided. The weights are positioned on the trailing region of the support. The weights include an outermost weight in facing contact with the rearward section of the rearward component. The weights also include an innermost weight in facing contact with the intermediate region of the support. Each weight is of substantially the same weight as the other weights.

A string is next provided. The string is formed with an enlarged spherical end positioned within the recess of the forward section. The string is adapted to facilitate handling of the system.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved exercise device which has all of the advantages of the prior art pelvic muscle strengthening devices and none of the disadvantages.

It is another object of the present invention to provide a new and improved exercise device which may be easily and efficiently manufactured and marketed.

It is further object of the present invention to provide a new and improved exercise device which is of durable and reliable constructions.

An even further object of the present invention is to provide a new and improved exercise device which is susceptible of a low cost of manufacture with regard to both materials and labor, and which accordingly is then susceptible of low prices of sale to the consuming public, thereby making such exercise device economically available to the buying public.

Even still another object of the present invention is to provide an exercise device for strengthening pelvic muscles.

Lastly, it is an object of the present invention to provide a new and improved pelvic exercise device comprising a forward component having a frusto-conical forward section terminating in a recess and a cylindrical rearward section terminating with male screw threads; a rearward component having a cylindrical forward section terminating with female threads and a rearward section with a cylindrical recess; a support, removably positioned within the forward and rearward components, having a frusto-conical leading region, an intermediate region, and a cylindrical trailing region; and a plurality of annular weights with cylindrical apertures positioned on the trailing region of the support.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of an exercise device constructed in accordance with the principles of the invention.

FIG. 2 is a front elevational view taken alone line 2-2 of FIG. 1.

FIG. 3 is a cross sectional view taken along line 3-3 of FIG. 2.

FIG. 4 is an exploded perspective illustration of the system of the prior Figures.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved exercise device embodying the principles and concepts of the present invention and generally designated by the reference numeral 10 will be described.

The present invention, the exercise device 10 is comprised of a plurality of components. Such components in their broadest context include a forward component, a rearward component, a support, and a plurality of annular weights. Such components are individually configured and correlated with respect to each other so as to attain the desired objective.

The exercise device 10 is for insertion into the vagina of a patient for use in strengthening pelvic muscles. First provided is a forward component 12. The forward component has an inner surface, an outer surface, and a hollow interior. The forward component has a frusto-conical forward section 14 terminating in a forward recess 16 extending into the outer surface. The forward component has a cylindrical rearward section 18 terminating rearwardly. Male screw threads 20 are provided in the outer surface.

Next provided is a rearward component 24. The rearward component has an inner surface, an outer surface, and a hollow interior. The rearward component has a cylindrical forward section 26 terminating forwardly. Female screw threads 28 are provided in the inner surface. The rearward component has a hemispherical rearward section 30. A cylindrical recess 32 is provided in the inner surface. The male screw threads of the forward component are adapted to releasably couple with the female screw threads of the rearward component for providing access to the hollow interiors of the forward and rearward components.

A support 34 is next provided. The support is removably positioned within the hollow interiors of the forward and rearward components. The support has a frusto-conical leading region 36 positioned in the forward section of the forward component. The support has a cylindrical intermediate region 38 positioned in the rearward section of the forward component. The support has a cylindrical trailing region 40 positioned in the forward section of the rearward component and terminating in a trailing end 42 positioned within the cylindrical recess of the rearward component.

Next, a plurality of similarly configured annular weights 46, 48, 50 with cylindrical apertures 52 are provided. The weights are positioned on the trailing region of the support. The weights include an outermost weight 50 in facing contact with the rearward section of the rearward component. The weights also include an innermost weight 46 in facing contact with the intermediate region of the support. Each weight is of substantially the same weight as the other weights.

A string 54 is next provided. The string is formed with an enlarged spherical end 56 positioned within the recess of the forward section. The string is adapted to facilitate handling of the system.

Variations in the characteristics of the system may be achieved by various techniques, including varying the size of the support member and/or varying the number of annular weights.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. An exercise device comprising:

a forward component having a frusto-conical forward section terminating in a recess, the forward component having a cylindrical rearward section terminating with male screw threads;

a rearward component having a cylindrical forward section terminating with female screw threads, the rearward component having rearward section with a cylindrical recess;

a support removably positioned within the forward and rearward components, the support having a frusto-conical leading region and an intermediate region and a cylindrical trailing region;

a plurality of annular weights with cylindrical apertures positioned on the trailing region of the support, the weights including an outermost weight in facing contact with the rearward section of the rearward component and an innermost weight in facing contact with the intermediate region of the support, each weight weighing substantially the same; and a string formed with an enlarged spherical end positioned within the recess of the forward section, the string adapted to facilitate handling of the device, the enlarged spherical end formed separately from and forwardly of the support and the weights.

2. An exercise device (10) for insertion into the vagina of a patient to strengthen pelvic muscles, the exercise device comprising, in combination:

a forward component (12) having a hollow interior and an inner surface and an outer surface, the forward component having a frusto-conical forward section (14) terminating in a forward recess (16) extending into the outer surface, the forward component having a cylindrical rearward section (18) terminating rearwardly with male screw threads (20) in the outer surface;

a rearward component (24) having a hollow interior and an inner surface and an outer surface, the rearward component having a cylindrical forward section (26) terminating forwardly with female screw threads (28) in the inner surface of the rearward component, the rearward component having a hemispherical rearward section (30) with a cylindrical recess (32) in the inner surface of the rearward component, the male screw threads of the forward component adapted to releasably couple with the female screw threads of the rearward component for providing access to the hollow interiors of the forward and rearward components;

a support (34) removably positioned within the hollow interiors of the forward and rearward components, the support having a frusto-conical leading region (36) positioned in the forward section of the forward component, the support having a cylindrical intermediate region (38) positioned in the rearward section of the forward component, the support having a cylindrical trailing region (40) positioned in the forward section of the rearward component and terminating in a trailing end (42) positioned within the cylindrical recess of the rearward component;

a plurality of similarly configured annular weights (46) (48) (50) with cylindrical apertures (52), the weights being positioned on the trailing region of the support, the weights including an outermost weight (50) in facing contact with the rearward section of the rearward component, the weights including an innermost weight (46) in facing contact with the intermediate region of the support, each weight weighing substantially the same; and a string (54) formed with an enlarged spherical end (56) positioned within the recess of the forward section of the forward component, the string adapted to facilitate handling of the device, the enlarged spherical end formed separately from and forwardly of the support and the weights.

* * * * *